US010169944B2

(12) United States Patent
Razzaboni et al.

(10) Patent No.: US 10,169,944 B2
(45) Date of Patent: Jan. 1, 2019

(54) DEVICE FOR OPTIMISING THE FILLING OF BAGS FOR CONTAINING BANKNOTES

(71) Applicant: Cima S.p.A., Mirandola (MO) (IT)

(72) Inventors: Nicoletta Razzaboni, Mirandola (IT); Vittorio Razzaboni, Mirandola (IT)

(73) Assignee: CIMA S.P.A., Mirandola (MO) (IT)

( * ) Notice: Subject to any disclaimer, the term of this patent is extended or adjusted under 35 U.S.C. 154(b) by 467 days.

(21) Appl. No.: 14/889,066

(22) PCT Filed: May 8, 2014

(86) PCT No.: PCT/IB2014/061304
§ 371 (c)(1),
(2) Date: Nov. 4, 2015

(87) PCT Pub. No.: WO2014/181290
PCT Pub. Date: Nov. 13, 2014

(65) Prior Publication Data

US 2016/0098880 A1 Apr. 7, 2016

(30) Foreign Application Priority Data

May 9, 2013 (IT) ..... MI2013A0753

(51) Int. Cl.
*G07D 11/00* (2006.01)
*B65B 25/14* (2006.01)
(Continued)

(52) U.S. Cl.
CPC ..... *G07D 11/0009* (2013.01); *B65B 5/061* (2013.01); *B65B 5/106* (2013.01);
(Continued)

(58) Field of Classification Search
CPC ..... B65B 5/067; B65B 5/106; B65B 43/54; B65B 51/146; B65B 25/14; G07D 11/0009; G07D 11/0021; G07D 11/0096
(Continued)

(56) References Cited

U.S. PATENT DOCUMENTS 2,939,259 A * 6/1960 Heckler ..... B65B 67/04 493/450
3,017,730 A * 1/1962 Rodish ..... B65B 25/14 100/218
(Continued)

FOREIGN PATENT DOCUMENTS

CN 102246211 A 11/2011
DE 10 2009 003 994 A1 7/2010
(Continued)

OTHER PUBLICATIONS

Chinese Office Action dated May 2, 2017, with English translation (15 pages).
International Search Report dated Jul. 25, 2014.

*Primary Examiner* — Andrew M Tecco
*Assistant Examiner* — Nicholas Igbokwe
(74) *Attorney, Agent, or Firm* — Jacobson Holman, PLLC.

(57) ABSTRACT

A device for filling and closing disposable bags for containing banknotes, comprises a container for the temporary housing of one or more banknotes, having side walls and a bottom with an opening for the exit of said one or more banknotes from the container, a pushing piston for pushing said one or more banknotes towards the bottom of the container, a bag made of flexible material intended to be filled with the banknotes temporarily housed in the container, which is anchored, at the edges of its mouth, to fixing pins placed in proximity of the opening in the bottom of the container, a plate which is vertically movable through con-
(Continued)

Figure 2:
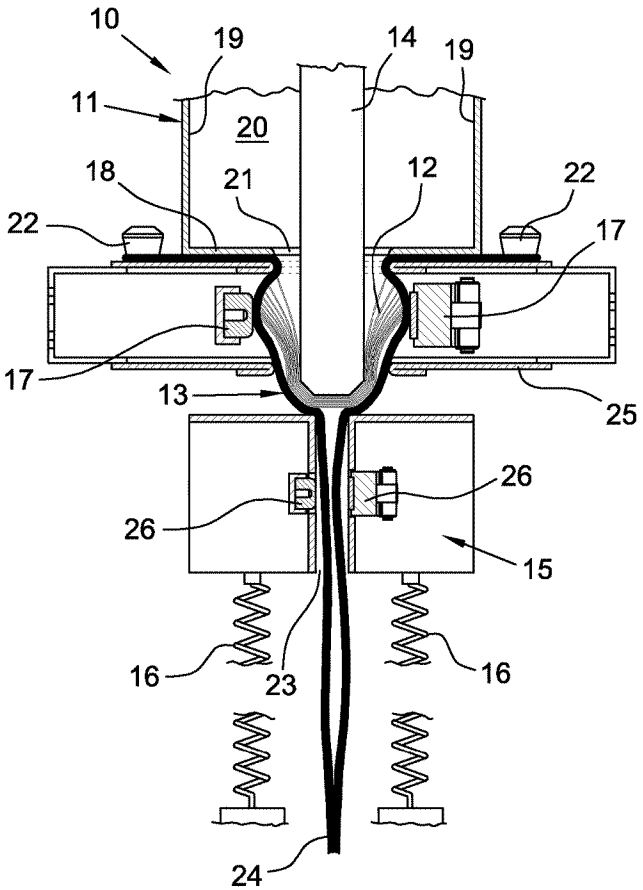

trolled lowering means and placed below the container, the plate having a central slot, which is open at the top towards the container and extending vertically through the body of the plate for the insertion of a bottom portion of the bag anchored to the fixing pins, and first sealing elements placed between the container and the plate.

9 Claims, 3 Drawing Sheets

(51) Int. Cl.

| | |
|---|---|
| ***B65B 35/40*** | (2006.01) |
| ***B65B 43/59*** | (2006.01) |
| ***B65B 51/14*** | (2006.01) |
| ***B65B 5/10*** | (2006.01) |
| ***B65B 5/06*** | (2006.01) |
| ***B65B 7/02*** | (2006.01) |
| ***B65B 39/06*** | (2006.01) |
| ***B65B 51/10*** | (2006.01) |

(52) U.S. Cl.
CPC ..... *B65B 7/02* (2013.01); *B65B 25/14* (2013.01); *B65B 35/40* (2013.01); *B65B 39/06* (2013.01); *B65B 43/59* (2013.01); *B65B 51/10* (2013.01); *B65B 51/146* (2013.01); *G07D 11/0021* (2013.01); *G07D 11/0096* (2013.01)

(58) Field of Classification Search
USPC ... 53/284.7, 531, 535, 570, 245, 258, 375.6; 271/23, 20
See application file for complete search history.

(56) References Cited

U.S. PATENT DOCUMENTS

| | | | | |
|---|---|---|---|---|
| 5,313,766 | A * | 5/1994 | Rimondi | B29C 65/229 53/245 |
| 6,076,566 | A * | 6/2000 | Lowe | B65B 67/1222 141/10 |
| 2002/0070496 | A1* | 6/2002 | Ito | B65H 29/16 271/177 |
| 2002/0171194 | A1* | 11/2002 | Kuroda | B65H 29/14 271/177 |
| 2004/0217536 | A1* | 11/2004 | Isobe | B65H 29/46 271/3.14 |
| 2005/0189702 | A1* | 9/2005 | Takeuchi | B65H 29/18 271/180 |
| 2008/0073177 | A1* | 3/2008 | Hansson | G07D 11/009 194/344 |
| 2009/0107798 | A1* | 4/2009 | Nireki | G07F 7/04 194/206 |
| 2010/0189379 | A1 | 7/2010 | Razzaboni et al. | |
| 2011/0052363 | A1* | 3/2011 | Brexel | B65B 9/15 414/798.2 |
| 2012/0047854 | A1* | 3/2012 | Wright | E05G 1/005 53/476 |

FOREIGN PATENT DOCUMENTS

| | | | | |
|---|---|---|---|---|
| DE | 10 2009 053 155 | | 5/2011 | |
| DE | 102009053155 | * | 5/2011 | B65B 25/14 |
| FR | 2 453 811 | | 11/1980 | |
| JP | 4351797 B2 | | 10/2009 | |
| WO | 02/19289 | | 3/2002 | |
| WO | 2012/115028 | | 8/2012 | |

* cited by examiner

DEVICE FOR OPTIMISING THE FILLING OF BAGS FOR CONTAINING BANKNOTES

BACKGROUND OF THE INVENTION

The present invention refers to a device for filling and closing disposable bags for containing paper documents, in particular banknotes.

Such device is intended to be used in machines for storing banknotes, usually present in banks, supermarkets, shopping malls or the like.

In the prior art, the banknotes are introduced into these machines through an inlet port and they are then inserted into boxes or into plastic bags removably housed in the machine.

In case of use of plastic bags, they can advantageously be of the disposable type, i.e. bags which, after filling, are sealed by appropriate sealing blades at the edges of the their mouth so that, once opened, they cannot be used again.

Obviously, the use of plastic bags instead of rigid boxes implies various difficulties both as regards fixing the bag to the machine and introducing the banknotes into the bag up to its correct filling, these difficulties essentially being due to lack of rigidity of the bag and in particular to the flexibility of its walls. On the other hand, the disposable plastic bags are simple and inexpensive to be made, they are light and easy to be handled and they do not require any maintenance.

US-A-2011/0052363 discloses a system in which a banknote is introduced one at a time, through a roller feeding device, into the bag, which is placed horizontally and fixed to a support frame provided with a seat within which the bag is initially rolled. Each banknote is introduced into the bag oriented vertically and, as the banknotes are progressively introduced into the bag, the pack that is thus formed is translated horizontally along a conveyor belt which supports it, thus causing an extension of the bag which unrolls from its seat. The pack of banknotes is laterally accompanied by a support plate at the bottom of the bag, while a pressing element on the opposed side of the pack with respect to the aforementioned support contributes to keep the banknotes constantly compact in the bag.

The solution described in this prior art document however implies a considerable structural complexity and, thus, even high production costs.

Document WO-A-02/19289 provides for a piston for facilitating the entry of the banknotes into the box or into a bag.

DE-A-102009053155 discloses a system for filling a bag, with a plate for the lower support of the bag containing the banknotes. The plate is vertically movable downwards as the bag is filled and it is provided with a central passage for the insertion of a "tail" portion of the bag. The machine also comprises a pair of plates, in intermediate position with respect to the height-wise extension of the bag, horizontally movable by acting from outside the bag so as to divide the bag into an upper portion and a lower portion. A piston is vertically movable to firstly compact the banknotes in the upper portion of the bag and then push them, due to the mutual departure movement of the pair of plates, in the lower portion of the bag.

However, this is a complex solution, with many movable parts. In addition, the bag is pressed between the horizontally movable plates and the banknotes stacked in the upper and lower portions, so that the aforementioned horizontal movement of the plates may lead to the risk of breaking the bag.

BRIEF SUMMARY OF THE INVENTION

A general object of the present invention is to overcome the aforementioned drawbacks by providing a device for filling and closing disposable bags for containing paper documents, in particular banknotes, capable of allowing an orderly depositing of the banknotes into the bag and that is simple and inexpensive to be obtained and easy to be used, without requiring complex and cumbersome mechanisms for moving the banknotes and the bag, and capable of optimizing the filling of the bag even in case of introduction of a limited number of banknotes.

With the aim of attaining such object it was conceived to provide, according to the invention, a device for filling and closing disposable bags for containing banknotes, comprising:

- a bag made of flexible material intended to be filled with the banknotes,
- a plate for the lower support of the bag containing the banknotes, which is vertically movable through means for the controlled lowering of said plate and provided with a central slot open at the top and extending vertically through the body of the plate for the insertion of a bottom portion of the bag,
- a pushing piston for pushing the banknotes towards said plate and
- first sealing elements placed above the plate, characterised in that it further comprises:
  - a container, placed above said plate, having side walls and a bottom defining an inner space for the temporary housing of one or more banknotes, said bottom having an opening for the exit of said one or more banknotes from the container when pushed by the piston,
- the bag being anchored, at the edges of its mouth, to fixing pins placed in proximity of the opening in the bottom of the container, laterally with respect to the container, and
- said first sealing elements being placed between the container and the plate.

With the aim of providing a better description of the innovative principles and advantages of the present invention, in the following there is a description of a possible embodiment applying such principles, with reference to the attached drawings.

BRIEF DESCRIPTION OF THE SEVERAL VIEWS OF THE DRAWING(S)

FIGS. 1-6 schematically illustrate, partially sectioned, a device according to the invention, represented in subsequent operating steps, starting from the beginning of the loading of the banknotes up to the sealing of the bag.

DETAILED DESCRIPTION OF THE INVENTION

The device is intended to be contained in known machines (not shown in the drawings attached herein) for storing banknotes, usually present in banks, supermarkets, shopping malls or the like. For the sake of description simplicity, herein reference shall be made to banknotes, but the device according to the invention may be equally used for treating and handling other paper documents in form of sheets.

In the figures it is schematically illustrated, partially sectioned, a device 10 consisting essentially of a container 11 within which the banknotes 12, intended to be introduced into a bag 13, are temporarily housed, of a pushing piston 14 for pushing the banknotes towards the bottom of the container 11, of a plate 15 for supporting the banknotes once they have been inserted into the bag, placed below the container 11 and which is vertically movable through controlled lowering means 16, and of first sealing elements 17, placed between the container 11 and the plate 15 and intended to seal the mouth of the bag once filling is completed.

Advantageously, according to a particularly simple and inexpensive embodiment, the means 16 for the controlled lowering of the plate 15 consists of a compression spring.

The container 11 comprises a bottom 18 and side walls 19, so as to define an inner space 20 adapted to receive the banknotes before they are introduced into the bag.

The banknotes, coming from a storage compartment inside the machine or directly from the entry port from outside, may be introduced into the space 20 singularly or by groups of several banknotes, using feeding means well known to the person skilled in the art and thus not shown in the drawings.

The bottom 18 of the container 11 is provided with an opening 21 aligned with the piston 14. The opening 21 has a passage section smaller than the surface of the banknotes, so that the banknotes not pushed by the piston 14 are held in the space 20 by resting the peripheral portions thereof at the sides of the opening 21.

The bag 13 (advantageously made of flexible plastic film) is anchored, at the edges of its mouth, to fixing pins 22 placed laterally with respect to the container 11, in proximity of the opening 21 in its bottom 18. The fixing to the pins 22 may be obtained, for example, by providing, from the origin, suitable holes on the bag, or by specifically providing such holes when applying the bag.

Advantageously, the pins 22 are integral with the structure which constitutes the container 11.

Figure 1:
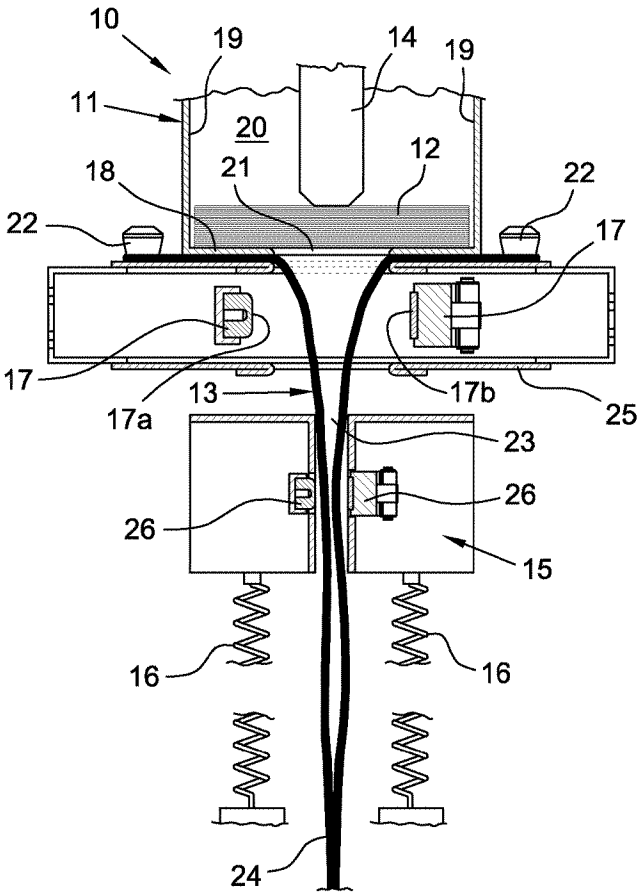

The plate 15 has a central slot 23, open at the top towards the container 11 and vertically extending through the body of the plate, in which the empty bag, hung to the fixing pins 22, is introduced with its "tail" 24 (i.e. the portion in proximity of its closed bottom) as observable in FIG. 1. Advantageously, the slot 23 is passing through, opening also at the lower part so as to allow an easy introduction of the bags regardless of their length.

FIG. 1 illustrates the device according to the invention in a first operating step, in which a bundle of banknotes 12 is temporarily received at the bottom of the space 20 of the container 11, directly resting on the bottom 18 of the container.

Though the operations of introducing the banknotes into the bag are herein described with reference to several banknotes stacked in bundles in the container 11, the same operating principles may also apply in cases where a single banknote is handled at a time so as to be introduced into the bag 13.

In the condition of FIG. 1, the plate 15 is unloaded and it is held in position of maximum lift by the force of the springs 16. The piston 14 is instead advantageously pushed downwards to hold the banknotes pressed against the bottom of the container 11.

FIG. 2 illustrates a subsequent operating step of the device according to the invention, in which the piston 14 exerts on the banknotes 12 a greater downward pressure (i.e. towards the plate 15) such to push the banknotes to be introduced with a central portion thereof into the opening 21 of the bottom 18 of the container 11 up to coming into contact with the plate 15, with the interposition of the plastic film forming the bag. In this step, the banknotes are deformed as illustrated in the figure so as to exit from the container 11 through the opening 21 and the bag widens due to the pushing action exerted by the banknotes.

As observable from the figures, the piston 14 has a transversal dimension smaller than the passage section of the opening 21, so as to be able to be inserted thereinto accompanying the banknotes towards the plate 15.

Figure 3:
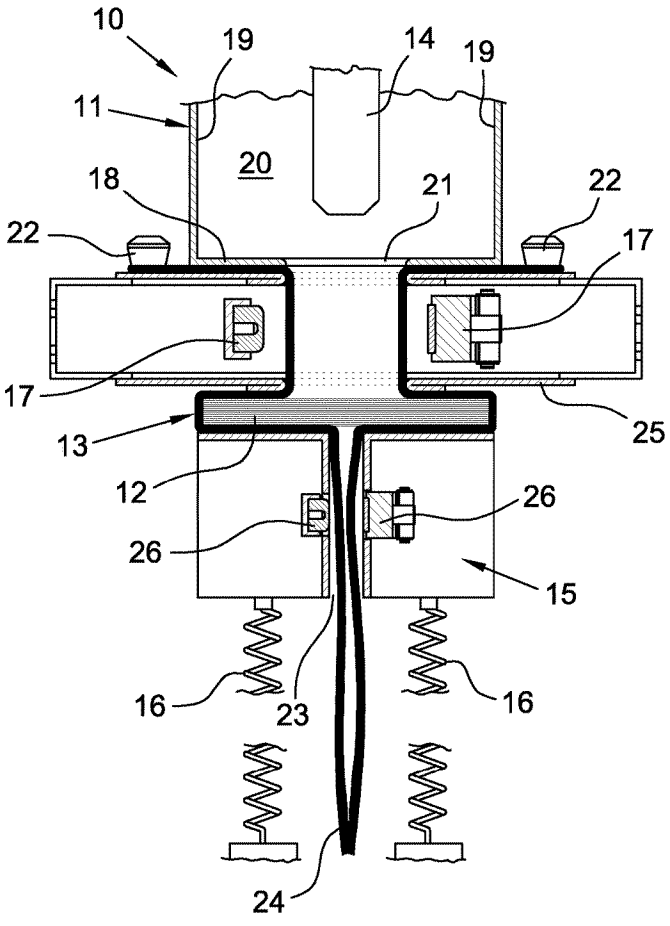

FIG. 3 illustrates a step immediately subsequent to the step of FIG. 2, where the bundle of banknotes has traversed the opening 21 pushed by the piston 14 and it is deposited (in the bag 13) on the plate 15.

Since the piston 14 is now receded upwards without exerting pressure on the banknotes any more, the upwards pressure of the plate 15 pushed by the springs 16 keeps the banknotes in the bag 13 compacted against the sealing elements 17 (still with interposition of the plastic film which constitutes the bag) or against appropriate sheets 25 for protecting the sealing elements, if provided for (as shown by way of example in the present FIGS. 1-6).

Figure 4:
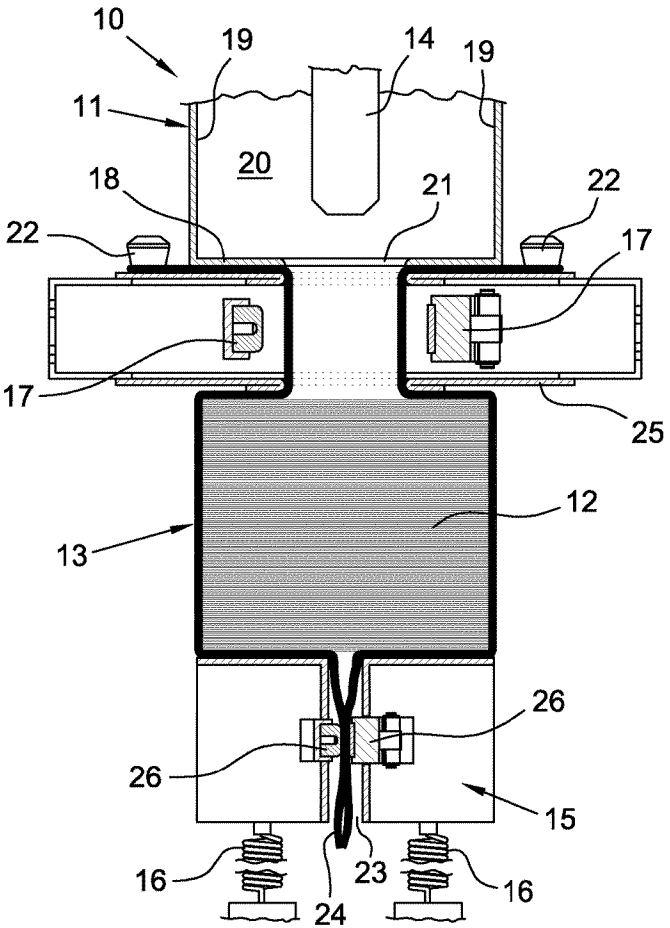

FIG. 4 illustrates a subsequent operating step where, through a sequence of operations like those described regarding FIG. 2, a plurality of bundles (or single banknotes) is passed from the container 11 to the bag 13. As the banknotes enter into the bag 13, their weight, alongside the thrust against them exerted each time by the piston 14, lowers the plate 15 against the action of the springs 16 and simultaneously widens the bag 13. The lowering of the plate 15 can advantageously occur along appropriate guides, as clearly imaginable by a person skilled in the art and thus not shown in the figures.

The widening of the bag, due to the increase of the number of banknotes therein, also causes a shortening thereof with respect to the original condition, which is obtained by a re-ascending of its tail 24 both in absolute terms with respect to the fixed parts of the device and in relative terms with respect to the movable plate 15.

From a static point of view, the rest condition illustrated in FIG. 4 is the same that occurs in intermediate loading steps (like in FIG. 2), awaiting the new banknotes to reach the container 11 so as to be introduced into the bag, i.e. with the banknotes in the bag 13 kept compacted between the plate 15 and the sealing elements 17 (or the protection sheets 25 thereof, if provided for).

The device 10 may also be advantageously provided with second sealing elements 26, placed on the plate 15 at the slot 23, suitable for carrying out a sealing in proximity of the tail 24 of the bag, beneath the banknotes 12 present therein. This step of sealing the tail of the bag is shown in FIG. 4.

The operation of sealing the bag in the tail portion thereof is particularly advantageous in cases where the bag should be closed without having been completely filled with banknotes to its full capacity. Actually, without the lower sealing, once the bag (closed at the top by means of the first sealing elements 17 as it shall be described hereinafter) is taken and removed from the plate 15, the banknotes contained therein would fall towards the initial bottom of the bag (in practice, widening and occupying the tail portion of the bag still available, which in FIG. 4 is shown housed in the lower part of the slot 23), thus easily being disorderly and however losing, during the subsequent handling of the bag, the compactness previously acquired on the plate 15. The benefits of this lower sealing grow proportionally to the lesser number of banknotes present in the bag.

Figure 5:
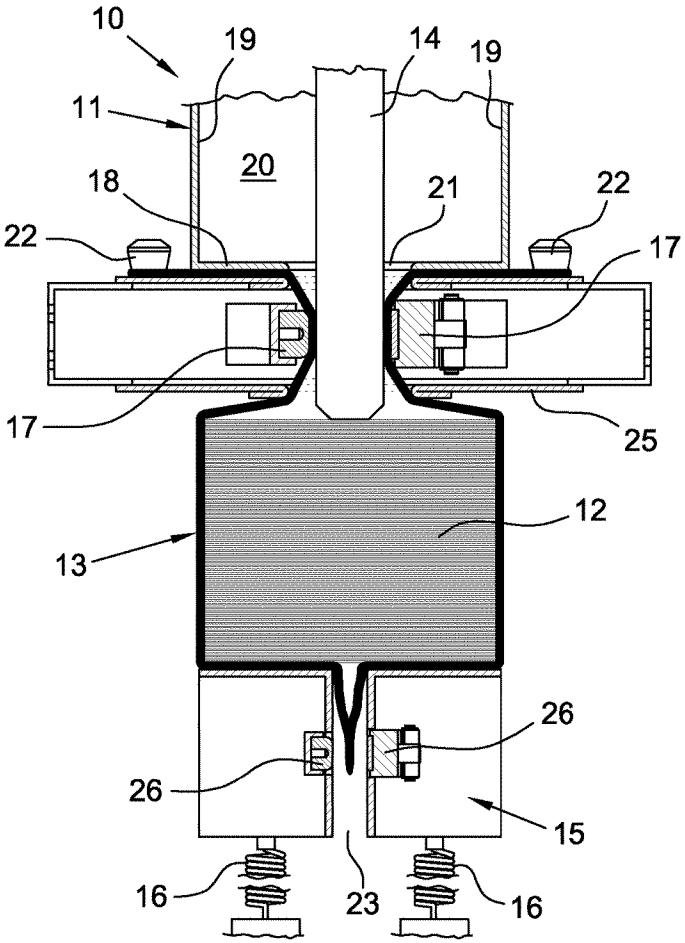

FIG. 5 illustrates the device 10 at the beginning of the operation of closing the bag. The piston 14 is lowered so as to move the banknotes away from the first sealing elements 17 (or from their protection sheets 24, if provided for), with a corresponding lowering of the plate 15 against the action of the springs 16. Simultaneously, said first sealing elements 17 are brought close to the piston 14.

Figure 6:
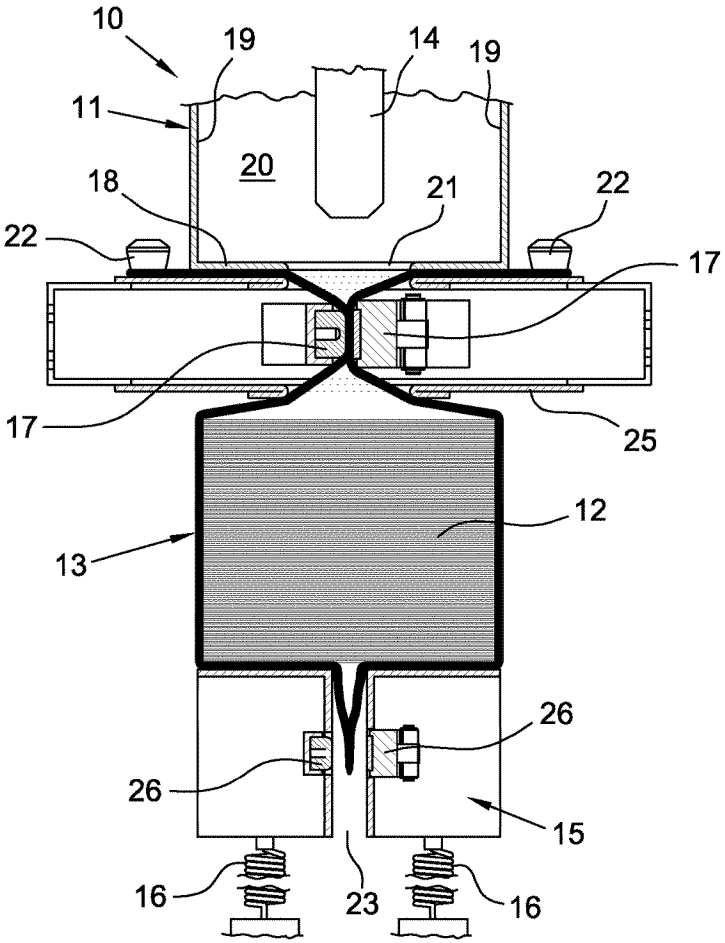

FIG. 6 illustrates the final step of sealing the bag. While the piston 14 is lifted to move away from the sealing area, the first sealing elements 17, horizontally movable, are drawn up close together and brought to mutual contact, with the plastic film which forms the bag interposed therebetween.

The heat sealing may be advantageously obtained by passing electrical current in the sealing bar 17*a* present on one of the two sealing elements while it is pressed against, the counter-bar 17*b* present on the other sealing element.

Then, the sealing elements 17 are moved away and the bag containing the banknotes can be picked up.

At this point, it is clear that, according to the invention, it has been possible to obtain a device for filling a bag with banknotes and its sealing, the device not being cumbersome, being easy and inexpensive to be obtained, as well as easy to be used and, in particular if the lower sealing is carried out, it allows optimising the filling of the bag even in cases where a limited number of banknotes is introduced.

Obviously, the above description outlining an embodiment applying the innovative principles of the present invention is provided by way of exemplifying such innovative principles and thus shall not be deemed to be a restriction of the scope of protection claimed herein.

For example, the elastic means 16 opposing the lowering of the plate 15 could also be obtained by traction springs or by gas springs.

Furthermore, the plate 15 may be made in a single element with the central slot, or two elements separated from each other, which move in a synchronised manner, could also be provided.

Lastly, the upper inlet of the slot 23 could be obtained with edges suitably rounded or, advantageously, provided with idle rollers at the edges of the slot, with the aim of facilitating the movement of the bag out of the slot without the danger of incurring damage due to dragging or tear when the device is in the conditions illustrated in FIGS. 3 and 4.

The invention claimed is:

1. A device for filling and closing disposable bags for containing banknotes, comprising:

a bag made of flexible material intended to be filled with the banknotes, a plate for the lower support of the bag containing the banknotes, which is vertically movable through a controlled lowering apparatus of said plate and provided with a central slot open at the top and extending vertically through the body of the plate for the insertion of a bottom portion of the bag, a pushing piston for pushing the banknotes towards said plate and first sealing elements placed above the plate, wherein the device further comprises:

a container, placed above said plate, having side walls and a bottom for direct support of the banknotes, defining an inner space for the temporary housing of one or more banknotes before their introduction into the bag, said bottom having an opening for the exit of said one or more banknotes from the container when pushed by the piston, the bag being anchored, at the edges of its mouth, to fixing pins placed in proximity of the opening in the bottom of the container, laterally with respect to the container, and said first sealing elements being placed between the container and the plate.

2. The device according to claim 1, wherein the central slot passes through the body of the plate, also open at the bottom thereof.

3. The device according to claim 1, wherein said controlled lowering apparatus consists of spring means and the plate is vertically movable against the pushing action of said spring means.

4. The device according to claim 1, wherein the device comprises second sealing elements, placed at the slot of the plate, suitable for carrying out a sealing at said bottom portion of the bag inserted in the slot.

5. The device according to claim 1, wherein the fixing pins of the mouth of the bag are integral with the structure which constitutes the container.

6. The device according to claim 1, wherein the opening for the exit of said one or more banknotes from the container is aligned with the piston.

7. The device according to claim 6, wherein the opening has a passage section smaller than the surface of the banknotes.

8. The device according to claim 7, wherein the piston has a transversal dimension smaller than the passage section of the opening.

9. The device according to claim 1, wherein the first sealing elements are horizontally movable towards each other to carry out a heat sealing of the mouth of the bag.

* * * * *